US005760531A

United States Patent [19]

Pederson

[11] Patent Number: 5,760,531

[45] Date of Patent: Jun. 2, 1998

[54] LAMP HAVING PROTECTIVE DOME

[75] Inventor: John C. Pederson, St. Cloud, Minn.

[73] Assignee: 911 Emergency Products, Inc., St. Cloud, Minn.

[21] Appl. No.: 753,042

[22] Filed: Nov. 19, 1996

[51] Int. Cl.[6] ..... H01J 61/30; H01J 61/34

[52] U.S. Cl. ..... 313/25; 313/634; 313/642; 313/643; 313/113; 313/110

[58] Field of Search ..... 313/25, 113, 110, 313/634; 362/231, 240, 247, 255, 256, 367

[56] References Cited

U.S. PATENT DOCUMENTS

| | | | |
|---|---|---|---|
| 4,390,931 | 6/1983 | Gorick et al. | 362/363 |
| 4,799,135 | 1/1989 | Inukai et al. | 313/113 |
| 5,220,235 | 6/1993 | Wakimizu et al. | 313/25 |
| 5,235,498 | 8/1993 | Van Dulmen et al. | 313/113 |
| 5,359,255 | 10/1994 | Kawai et al. | 313/113 |
| 5,526,237 | 6/1996 | Davenport et al. | 362/255 |
| 5,593,223 | 1/1997 | Koizumi | 362/255 |

*Primary Examiner*—Nimeshkumar Patel

*Attorney, Agent, or Firm*—Palmatier, Sjoquist, Voigt & Christensen, P.A.

[57] ABSTRACT

A xenon light assembly having a gas filled glass tube bent into a suitable shape and mounted to a base pedestal material. A glass dome is sized and mounted to seal and fit over the glass tube and about the base pedestal to provide a weather seal for the glass tube and to provide a superior color filtration to the light produced by the lamp.

11 Claims, 2 Drawing Sheets

LAMP HAVING PROTECTIVE DOME

BACKGROUND OF THE INVENTION

The present invention relates to electrical lamps; more particularly, the invention relates to high intensity lamps which operate on the gas discharge principle. Such lamps utilize a sealed compartment, usually a glass tube, which is filled with a particular gas known to have good illuminating characteristics. One such gas which is used for this purpose is xenon gas, which provides a brilliant illumination when it becomes ionized by the appropriate voltage application. Xenon gas lamps are used in the automotive industry to provide high intensity lighting and are used on emergency vehicles to provide a highly visible flashing emergency light.

A xenon gas lamp usually comprises a gas-filled tube which has an anode element at one end and a cathode element at the other end, with both ends of the tube sealed. The anode and cathode elements each have an electrical conductor attached, which passes through the sealed glass end to the lamp exterior. An ionizing trigger wire is typically wound in a helical manner about the exterior of the glass tube, and this wire is connected to a high voltage source, typically on the order of 10–12 kilovolts (kv). The anode and cathode connections are connected to a lower level voltage source which is sufficient to maintain illumination of the lamp once the interior gas has been ionized by the high voltage to a sufficient level to ignite the gas. The gas remains ignited until the anode/cathode voltage is removed, and once the gas ionization is stopped the lamp can be ignited again by reapplying the anode/cathode voltage and reapplying the high voltage to the trigger wire via a voltage pulse.

Xenon gas lamps are frequently made from glass tubes which are formed into semicircular loops to increase the relative light intensity from the lamp while maintaining a relatively small form factor. These lamps generate extremely high heat intensity as well as light intensity, and therefore care must be taken in positioning theses lamps so as not to cause heat buildup in nearby components. The glass tube of a xenon lamp is usually mounted on a light base pedestal which is sized to fit into an opening in a light fixture and to hold the heat generating tube surface in a light fixture compartment where it is spaced clear of interior compartment surfaces. In a vehicle application, the light and base pedestal are typically sized to fit through an opening in the light fixture which is about one-inch in diameter. The light fixture compartment may have a glass or plastic cover made from colored material so as to produce a colored lighting effect when the lamp is ignited. Xenon gas lamps naturally produce an intense white light, and this can be made to produce a colored light, of lesser intensity, by placing the xenon lamp in a fixture having a colored lens. The glass tube of a xenon lamp can be painted or otherwise colored to produce a similar result, although the intense white illumination from the tube tends to dominate the coloring, and the light may actually have a colored tint appearance rather than a solid colored light. The color blue is particularly hard to produce in this manner.

Because a preferred use of xenon lamps is in connection with emergency vehicles, it is particularly important that the lamp be capable of producing intense coloring of the colors associated with emergency vehicles; ie., red, blue, amber, green and clear.

When xenon lamps are mounted in vehicles, some care must be taken to reduce the corroding effects of water and various chemicals, including road salt, which might get into the light fixture. Corrosive effects can destroy the trigger wire, and the wire contacts leading to the anode and cathode. Corrosion is enhanced because of the high heat generating characteristics of the lamp, which can heat the air inside the light fixture when the lamp is in use, and this heated air can condense when the lamp is off to build up moisture inside the fixture. The buildup of moisture can short out the electrical wires and degrade the performance of the ignition wire, sometimes preventing proper ionization of the gas.

It is an object and advantage of the present invention to provide a xenon lamp which produces brilliant lighting in any of the colors associated with emergency vehicle use, such as red, blue, amber, green, and clear.

It is another object and advantage of the present invention to provide a lamp package which is highly resistant to corrosive effects and is sealed to prevent moisture buildup.

It is a further object and advantage of the present invention to provide a high intensity light which has an extended life cycle and continues to operate at maximum efficiency throughout its life cycle.

SUMMARY OF THE INVENTION

The invention comprises a xenon light package having a glass tube forming a tight, 360-degree bend, with the two tube ends terminating on the same plane, wherein the interior of the tube is filled with an ignitable gas and a cathode and anode are respectively positioned proximate the tube ends in the tube interior; and the tube ends are sealed with conductors connected to the anode and cathode and extending outside the tube. A trigger wire is helically wound about the tube exterior and formed into a third conductor. The three conductors pass through a base pedestal and form electrical contacts at the bottom of the base pedestal. A formed, high temperature glass dome is fitted over the curved tube assembly and is seated against the base pedestal to sealably enclose the glass tube and trigger wire in a transparent housing. The glass dome may be made from clear glass material or from colored glass material to provide a high intensity lamp of any desired color. The lamp and glass dome combination may be constructed as a replacement lamp unit for insertion into vehicle light fixtures.

The objects and advantages of the invention will become apparent from the following specification and claims and with reference to the appended drawings.

DESCRIPTION OF THE PREFERRED EMBODIMENT

Figure 1:
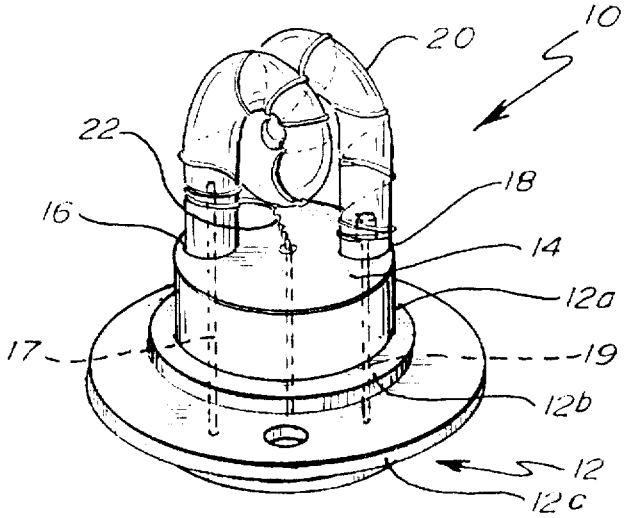
FIG. 1 shows a perspective view of a xenon lamp of the type forming a part of this invention.

FIG. 1 shows a perspective view of a xenon lamp 10. Lamp 10 has a base pedestal 12 which is typically made from rubber, plastic, or other insulated material. Base pedestal 12 has a top surface 14 which supports a glass tube 20 which has a looped curve such that an anode end 16 and a cathode end 18 are each supported on top surface 14. The anode and cathode ends 16, 18 are sealed and respective electrical conductors 17, 19 pass through the sealed ends and through the top surface 14.

A trigger wire 22 is helically wound about the exterior surface of glass tube 20, and the ends of wire 22 are passed through the top surface 14 of base pedestal 12 to form a third conductor on the underside of pedestal 12.

Figure 2:
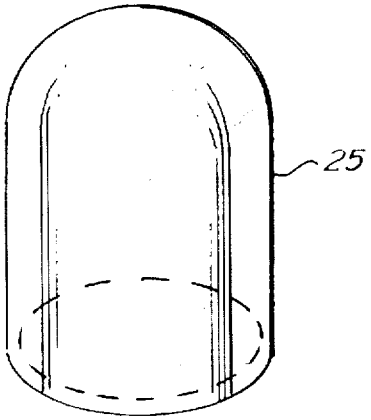
FIG. 2 shows a perspective view of a glass dome forming another part of this invention.

Base pedestal 12 has an upper cylindrical portion 12*a* extending from a lower shoulder 12*b*, all of which extends above a lower rim 12*c*. FIG. 2 shows a perspective view of a glass dome which is sized to fit over xenon lamp 10 and to rest on the raised shoulder 12*b*. The glass dome 25 is preferably made from a transparent bore silicate glass material capable of withstanding heat stress. The outer diameter of glass dome 25 is typically about one inch which is sized to fit through the conventional opening in a typical vehicle lamp fixture. The exterior glass dome surface typically has a much lower temperature during operation than the exterior surface of the glass tube forming a part of the lamp. This makes it easier to color the dome and to provide a brilliant colored lamp by virtue of the xenon light intensity passing through the colored dome.

Figure 3:
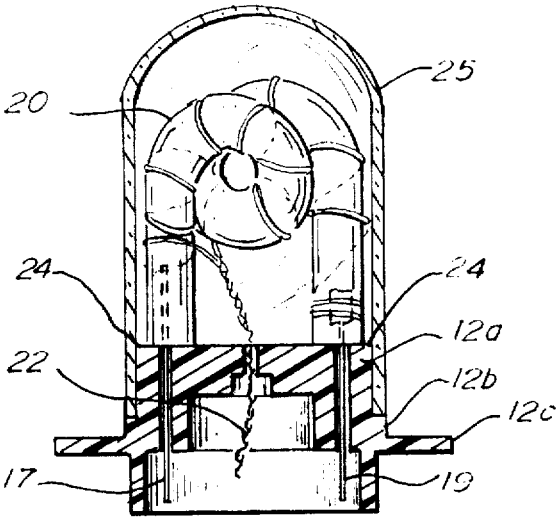
FIG. 3 shows an elevation view, in partial cross section, of the xenon lamp and glass dome in an operative configuration.

FIG. 3 shows a partial cross-section view of dome 25 seated over xenon lamp 10. The inside surface of dome 25 is fitted over the upper cylindrical portion 12*a* of base pedestal 12. A silicone-based sealant 24 is applied between the contacting surfaces of dome 25 and base pedestal 12. It is important that a sealant be selected which is of the type that does not outgas after application. One sealant which has been found to be satisfactory for the purpose, is a two component silicone-based sealant manufactured by Dupont under the trademark SILGUARD®. Any outgassing from the sealant after application may develop a film over the interior surface of dome 25 and may thereby cloud the surface so as to reduce the transparency of the glass dome 25. The lower edge of the glass dome 25 rests atop shoulder 12*b*, all of which provides a very tight water-proof seal arrangement to protect the interior components within the glass dome 25. FIG. 3 also shows the anode wire 17, cathode wire 19 and trigger wire 22 which pass through the base pedestal 12 and project outwardly beneath the lower interior surface of base pedestal 12. Each of these three wires may be then electrically connected to a suitable connector plug to provide the necessary operation.

Figure 4:
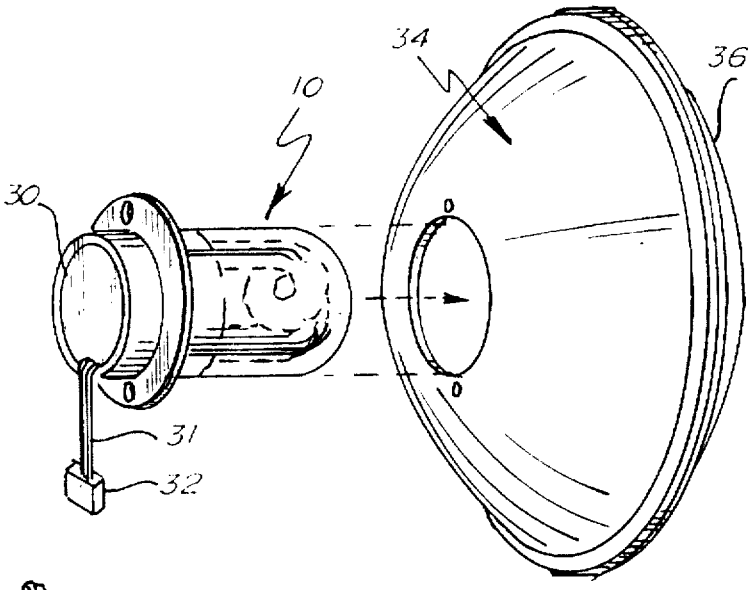
FIG. 4 shows a perspective view of a xenon lamp and vehicle light fixture prior to mounting.
Figure 5:
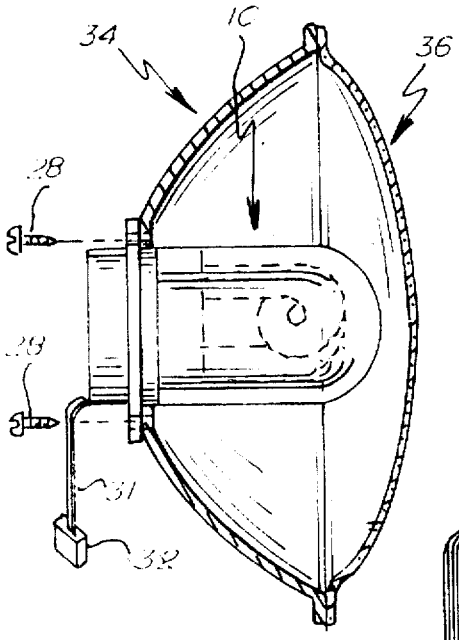
FIG. 5 shows a cross-section view of the lamp and light fixture after mounting.

FIG. 4 shows a perspective view of a xenon lamp 10 aligned for insertion into the conventional opening of a light reflector 34. In this example, the light receptacle opening 35 is typically about one inch in diameter; and the glass dome and pedestal are sized to fit into this opening. This figure shows the xenon lamp 10 in its final construction form with a cover plate 30 affixed over the bottom opening of base pedestal 12 and with three electrical connector wires 31 extending therefrom and connected to an electrical plug connector 32. Reflector 34 may be a conventional light reflector of the type found in vehicles having a clear plastic or glass lens cover 36. FIG. 5 shows the light assembly of FIG. 4 after the xenon lamp 10 has been inserted through the opening 35. Fasteners 28 may be used to affix the base pedestal 12 to the rear side of the reflector 34.

Figure 6:
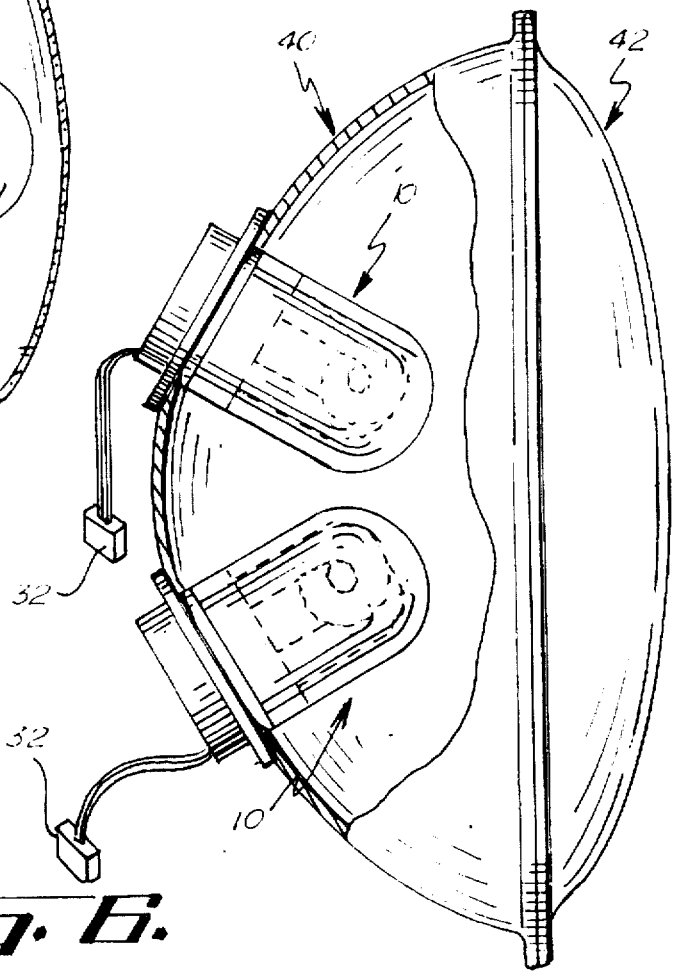
FIG. 6 shows a vehicle light fixture having two lamp assemblies mounted therein.

FIG. 6 shows an alternative embodiment in side view and in partial cross section, wherein two openings have been created through a light reflector 40; and two xenon lamps 10 have been inserted into these openings. A clear plastic or glass lens cover 42 is fitted over the front edge of the reflector 40 in a manner which is conventional with vehicle lamps. In this example, the lamps 10 could be fitted with different color glass domes; i.e., one red glass dome and one blue glass dome. The lamps could then be wired to a flashing alarm circuit to cause the light fixture to alternatively flash red and blue or any other color combination. The light fixture could be a headlight light fixture, wherein the lamps 10 are mounted into the reflector 40 on either side of a centrally-mounted halogen light bulb which is used as a headlight lamp. In this case, the light fixture could perform its normal function as a headlight and could alternatively flash several additional colors, depending upon the needs of the user. This configuration provides an emergency flashing light construction which is wholly concealed within the normal head lamp of a vehicle and is, therefore, not readily visible from outside the vehicle unless the lights are flashing. This construction may find application in an unmarked emergency vehicle such as might be used by some law enforcement officers.

In operation, the invention may be constructed as a replacement part for a conventional incandescent lamp. The base pedestal and glass dome assembly may be sized to readily fit into the same light opening as an incandescent lamp would require, although it is apparent the electrical driving circuit for the xenon lamp would have to be modified to accommodate the gas discharge operating principles. The lower rim 12*c* can provide a weather seal to keep moisture away from contact with the lower conductors 17, 19, 22. Of course, the glass dome 25 provides an adequate seal to keep moisture and other contaminants away from contact with the glass tube 20 and other interior components.

The present invention may be embodied in other specific forms without departing from the spirit or essential attributes thereof; and it is, therefore, desired that the present embodiment be considered in all respects as illustrative and not restrictive, reference being made to the appended claims rather than to the foregoing description to indicate the scope of the invention.

What is claimed is:

1. A gas discharge lamp and protective glass dome, comprising:

(a) an integral base pedestal without air passages having a cylindrical upper portion and a circumferential shoulder about said upper portion;

(b) a xenon-filled glass tube supported on said base pedestal, said xenon-filled glass tube having an anode wire, a cathode wire, and a trigger wire extending therefrom and passing through said base pedestal; and (c) a glass dome fitted over said cylindrical upper portion, said dome having a lower edge resting on said shoulder and a sealant engaged to said lower edge and said shoulder establishing an airtight configuration between said glass dome and said base pedestal, said glass dome further being tinted for the provision of a colored light and being separated from said glass tube to dissipate heat generated by said glass tube.

2. The apparatus of claim 1, wherein said glass tube is bent into a 360° loop and the respective ends of said tube are supported on said base pedestal.

3. A gas discharge lamp and protective dome, comprising:

(a) a sealed glass tube having xenon gas entrapped therein and having an anode electrode and a cathode electrode, and respective electrical conductors connected to said electrodes and passing through said glass tube;

(b) an electrical trigger conductor helically wound about the exterior surface of said tube;

(c) a base pedestal having an upper surface supporting said tube, and having a cylindrical upper portion and having a recessed lower surface, said electrical conductors all passing through said base pedestal without establishing air passages and having respective conductor ends projecting from said lower surface; and (d) a cylindrical glass dome fitted about said base pedestal cylindrical upper portion, whereby said sealed glass tube is enclosed by said glass dome and a sealant engaged to said glass dome and to said base pedestal cylindrical upper portion establishing an airtight configuration between said glass dome and said base pedestal cylindrical upper portion minimize condensation and clouding within said glass dome, said glass dome being separated from said glass tube to dissipate heat generated by said glass tube.

4. The apparatus of claim 3, wherein said glass dome is made from bore silicate material.

5. The apparatus of claim 4, wherein said glass dome is colored.

6. The apparatus of claim 5, wherein said glass tube is formed into a complete loop wherein respective ends of said tube are aligned in side-by-side relationship.

7. A gas discharge lamp and light fixture, comprising:

(a) a lamp base and xenon-filled tube supported on said lamp base, said lamp base having a cylindrical portion having a diameter of about one inch;

(b) a glass dome fitted over said xenon-filled tube and sealed about the cylindrical portion of said lamp base establishing an airtight configuration between said glass dome and said cylindrical portion to minimize condensation and clouding within said glass dome, said glass dome being separated from said glass tube to dissipate heat generated by said tube;

(c) a light reflector having an opening slightly larger than said cylindrical lamp base portion, and means for attaching said lamp base to said light reflector; and (d) a lens cover fitted over said light reflector, thereby creating a closed compartment for said glass dome.

8. The apparatus of claim 7, wherein said lamp base further comprises a shoulder for attaching to said reflector.

9. The apparatus of claim 8, wherein said glass dome is colored and semi-transparent.

10. A gas discharge lamp assembly, comprising:

(a) a light reflector having a reflective forwardly facing surface and a rear surface;

(b) at least two circular openings through said light reflector; each opening being sized to receive a xenon discharge lamp;

(c) a pair of xenon discharge lamps in said openings, each lamp having a base pedestal and a cylindrical portion, and a glass dome sealed about said cylindrical portion and projecting forwardly adjacent said reflective surface each of said glass domes being in airtight sealing engagement with said cylindrical portions to minimize condensation and clouding within said glass domes, said glass domes being separated from said xenon discharge lamps to disburse heat generated by said xenon discharge lamps; and (d) a lens cover fitted about the edge of said light reflector, thereby forming a light compartment for said pair of xenon discharge lamps.

11. The apparatus of claim 10, wherein said lens cover is a clear, non-colored material and each of said glass domes is a colored material.

* * * * *